United States Patent [19]

Arakawa et al.

[11] Patent Number: 4,632,283

[45] Date of Patent: Dec. 30, 1986

[54] MOLTEN METAL DISCHARGING DEVICE

[75] Inventors: Kazumi Arakawa, Anjo; Masuo Sugie, Tokoname; Takashi Watanabe, Chiryu; Takumi Nishio, Toyota; Toshio Kawamura, Takahama; Tsutomu Nagahata, Osaka; Takashi Matsushita, Wakayama, all of Japan

[73] Assignees: Toshiba Ceramics Co., Ltd., Tokyo; Sumitomo Metal Industries, Ltd., Osaka, both of Japan

[21] Appl. No.: 581,510

[22] Filed: Feb. 17, 1984

[30] Foreign Application Priority Data

Nov. 2, 1983 [JP] Japan ..... 58-206477
Nov. 2, 1983 [JP] Japan ..... 58-206478
Nov. 2, 1983 [JP] Japan ..... 58-206480

[51] Int. Cl.[4] ..... B22D 41/08

[52] U.S. Cl. ..... 222/600; 222/603; 266/271

[58] Field of Search ..... 222/603, 600, 598, 597, 222/594, 591; 75/60; 266/266, 47, 271; 164/438, 337

[56] References Cited

U.S. PATENT DOCUMENTS

| | | | |
|---|---|---|---|
| 2,943,370 | 7/1960 | Murarsheed | 251/318 |
| 3,136,834 | 6/1964 | Lorenz | 266/210 |
| 3,253,307 | 5/1966 | Griffiths et al. | 222/591 X |
| 3,337,329 | 8/1967 | Finkl | 75/49 |
| 3,430,644 | 3/1969 | Lyman | 222/598 |
| 3,454,201 | 7/1969 | Fichera | 222/531 |
| 3,465,810 | 9/1969 | Sylvester | 164/259 |
| 3,581,948 | 6/1971 | Detalle | 222/603 |
| 3,731,912 | 5/1973 | Kutzer | 266/38 |
| 3,773,226 | 11/1973 | Kutzer | 222/148 |
| 3,838,798 | 10/1974 | Voss | 222/148 |
| 3,887,117 | 6/1975 | Fehling | 222/603 X |
| 4,091,971 | 5/1978 | Tinnes et al. | 222/603 |
| 4,179,046 | 4/1978 | Jeschke et al. | 222/600 |
| 4,253,647 | 3/1981 | Andres | 266/271 |
| 4,360,190 | 11/1982 | Ato | 222/603 X |
| 4,415,103 | 11/1983 | Shapland et al. | 222/603 X |
| 4,520,860 | 6/1985 | Haissig et al. | 222/603 X |

FOREIGN PATENT DOCUMENTS

| | | | |
|---|---|---|---|
| 69895 | 12/1975 | Australia . | |
| 498438 | 8/1976 | Australia . | |
| 501931 | 9/1977 | Australia . | |
| 500687 | 1/1979 | Australia . | |
| 508437 | 3/1980 | Australia . | |
| 68560/81 | 9/1982 | Australia . | |
| 1938117 | 12/1975 | Fed. Rep. of Germany . | |
| 808711 | 2/1937 | France | 222/603 |
| 1270625 | 1/1962 | France . | |
| 2053179 | 4/1971 | France . | |
| 5421533 | 5/1976 | Japan . | |
| 341949 | 12/1959 | Switzerland . | |
| 834234 | 5/1960 | United Kingdom . | |
| 2322375 | 7/1973 | United Kingdom . | |
| 2094454 | 3/1981 | United Kingdom . | |

*Primary Examiner*—H. Grant Skaggs
*Assistant Examiner*—Nils Pedersen
*Attorney, Agent, or Firm*—Oblon, Fisher, Spivak, McClelland & Maier

[57] ABSTRACT

A molten metal discharging device comprising:

a stationary plate adapted to be mounted at a bottom portion of a container accomodating molten metal, the stationary plate having a molten metal passage bore for permitting the molten metal from the container to be discharged therethrough, and a slide plate slidable along a lower face of the stationary plate and adapted to open or close the passage bore by being slidably displaced relative to the stationary plate, in which a circumferential wall of the passage bore in the stationary plate is made of dense refractory material and the circumferential wall made of the dense refractory material has a plurality of gas supply holes therein for permitting a gas to be supplied into the passage bore has less fear that the passage bore thereof may be blocked by the solidification of the molten metal and/or deposition of metal oxides and has an improved resistance against corrosion by the molten metal.

27 Claims, 8 Drawing Figures

MOLTEN METAL DISCHARGING DEVICE

BACKGROUND OF THE INVENTION

1. Field of the Invention

This invention is related to U.S. patent application Ser. No. 581,359 filed Feb. 17, 1984 and concerns a molten metal discharging device adapted to be mounted at a bottom portion of a container such as a ladle or tundish for use in the casting of molten metal or the like.

2. Discussion of the Background

In the case of casting molten steels, for instance, by way of a conventional continuous casting process, a molten metal discharging device comprising a stationary plate and a slide plate is attached to the bottom portion of a ladle or tundish accomodating the molten steel and the flow rate of the molten steel is adjusted by causing the slide plate to move slidably with respect to the stationary plate thereby opening or closing a passage bore, in the stationary plate, for the molten steel. In the above-mentioned molten metal discharging device, an inert gas such as argon is introduced from the stationary plate into the molten steel so as to prevent the clogging in the passage bore caused by the solidification of the molten steels and/or deposition of oxides of metal or metalloid such as Al, Ti, Ca, Cr, Mn, Si or Ni.

Such type of the conventional molten metal discharging device is shown in FIG. 1.

In FIG. 1, an upper nozzle 1 having a molten metal passage bore 1*a* is secured to a bottom portion of a tundish (not illustrated). Below the upper nozzle 1, is attached a molten metal discharging device 14 comprising an upper stationary plate 2, a slide plate 3 and a lower stationary plate 4 having molten metal passage bores 2*a*, 3*a*, 4*a* respectively. The slide plate 3 is moved slidably between the upper stationary plate 2 and the lower stationary plate 4 in the direction of A or B to open or close the passage bores 2*a*, 3*a*, 4*a* thereby adjusting the flow rate of the molten steel and completely closing the passage bores 2*a*, 3*a*, 4*a*. The main body 2*b* of the upper stationary plate 2 is made of dense refractory material and an annular gas supply member 5 made of porous refractory material is tightly fitted over the entire circumference of the upper and enlarged inner circumferential wall surface 2*c* of the main body 2*b*. A gas pressure-uniformalizing zone 6 in the form of an annular space is defined between the annular porous refractory member 5 and the main body 2*b* of the upper stationary plate 2. Further, a gas introduction hole 7 communicated with the gas pressure-uniformalizing zone 6 is formed in the upper stationary plate 2, and a gas introduction pipe (not shown) is connected to the gas introduction hole 7. A submerged nozzle 8 is attached at the bottom of the lower stationary plate 4 and inserted at the lower end thereof into a mold 9.

In the illustrated conventional device 14, molten steels poured from the tundish (not illustrated) is supplied to the mold 9 through the passage bores 1*a*, 2*a*, 3*a*, 4*a* and 8*a* respectively formed in the upper nozzle 1, the upper stationary plate 2, the slide plate 3, the lower stationary plate 4 and the submerged nozzle 8 and then cooled within and below the mold 9. As the result, a molten layer 10, a partially-molten layer 11 and a solidified layer 12 are formed within and after or below the mold 9. Numeral 13 represents a mold powder layer 13 disposed above the molten layer 10.

In the molten metal discharging device 14 as described above, a gas is introduced from the gas introduction hole 7 into the molten steel through the gas supply member 5 to agitate the molten steel when the molten steels are started to be poured from the ladle to the tundish, thereby preventing the solidification of the molten steel within the passage bore 2*a* in the upper stationary plate 2 and facilitating the initial opening of the bore 2*a*. Further, the gas is introduced through the porous gas supply member 5 to agitate the molten steel also during casting for preventing the solidification of the molten steel and/or deposition of metal oxides to thereby prevent the clogging in the bore 2*a*, etc. Furthermore, supply of the gas serves to float up the oxides or impurities in the molten steel to reduce the content of the oxides or impurities incorporated in the steels to 1/5–1/10 as compared with those steel products obtained without such gas supply.

However, the foregoing conventional molten metal discharging device 14 has the drawbacks due to the use of the gas supply member 5 made of porous refractory material for the supply of the gas into the molten steel as described below:

(a) Since the sizes of the gas bubbles introduced into the molten steel are relatively small, agitating effects by the gas bubbles are relatively low, therefore a reliable prevention of the clogging in the passage bore 2*a*, etc. cannot always be expected.

(b) The gas introduction member is inferior in the corrosion-resistance due to its porous texture.

This invention has been accomplished in view of the above and the object thereof is to provide a molten metal discharging device at least capable of minimizing the foregoing problems, that is, a molten metal discharging device having less fear that the molten metal passage bore may be blocked by the solidification of molten metal and/or deposition of metal oxides, and having an improved corrosion-resistance to the molten metal.

SUMMARY OF THE INVENTION

The foregoing object can be attained by a molten metal discharging device according to this invention comprising:

a stationary plate adapted to be mounted at a bottom portion of a container accomodating molten metal, the stationary plate having a molten metal passage bore for permitting the molten metal from the container to be discharged therethrough, and a slide plate slidable along a lower face of the stationary plate and adapted to open or close the passage bore by being slidably displaced relative to the stationary plate, in which a circumferential wall of the passage bore in the stationary plate is made of dense refractory material and the circumferential wall made of the dense refractory material has a plurality of gas supply holes therein for permitting a gas to be supplied into the passage bore.

In the molten metal discharging device according to this invention, since a gas of a relatively large bubble size or diameter can be supplied into the passage bore by way of a plurality of gas supply holes formed in dense refractory material, fear of clogging in the passage bore can be reduced. In addition, since the circumferential wall of the passage bore is made of dense refractory material, its corrosion-resistance against the molten metal can be improved.

In this specification, the term "dense refractory material" means such refractory material that are produced to have such a high density as substantially prevent the gas from permeating therethrough. While on the other hand, the term "porous refractory material" means such refractory materials that are produced so as to have relatively fine pores substantially allowing the gas to permeate therethrough in the state they are shaped as a member.

The refractory material used for the stationary plate and the sliding plate may preferably be highly corrosion-resistant materials such as high alumina refractories, magnesia refractories, zircon refractories, or zirconia refractories.

According to this invention, the stationary plate, preferably, has a gas introduction hole communicated with the plurality of gas supply holes so as to supply the gas from an outside to the plurality of gas supply holes. The stationary plate, preferably, has a chamber therein for communicating the gas introduction hole with the plurality of gas supply holes, and the chamber is adapted such that the gas may be supplied from each of the plurality of gas supply holes substantially at a same level of pressure into the molten metal passage bore.

In one preferred embodiment of the molten metal discharging device according to this invention, the gas supply holes are distributed substantially uniformly over the circumferential wall of the passage bore in a circumferential direction thereof. In the molten metal discharging device of this embodiment, the stationary plate may either be molded integrally with dense refractory material or the stationary plate may comprise a gas supply member made of dense refractory material that constitutes at least a part of the circumferential wall of the passage bore and a main body of a stationary plate made of dense refractory material to which the gas supply member is tightly fitted, the gas supply holes being formed in the gas supply member. In the latter case, it is preferred that the gas introduction hole is formed in the main body of the stationary plate and the chamber is defined by the gas supply member and the main body of the stationary plate.

In another preferred embodiment of the molten metal discharging device according to this invention, the gas supply holes are formed much more on one side of the circumferential wall in the sliding direction of the slide plate than on the other side thereof. Preferably, the gas supply holes are disposed within a predetermined range in the circumferential direction of the passage bore only on said one side of the circumferential wall and, more preferably, this one side is a side of the circumferential wall of the passage bore from which the bore is started to be closed by the slide plate when the slide plate is moved to close the passage bore. The predetermined range in which the gas supply holes are disposed is, preferably, a range of between $\frac{1}{3}$–$\frac{2}{3}$ relative to an entire circumference of the passage bore.

If the range where the gas supply holes are to be disposed is smaller than $\frac{1}{3}$ of the entire circumference of the passage bore, the amount of the gas may become insufficient or the gas may not be supplied to the entire area in the passage bore, leading to the reduction in the effect of preventing clogging in the passage bore. While on the other hand, if the range is larger than $\frac{2}{3}$ of the entire circumference, an excess amount of the gas tends to be included in the molten metal poured into the mold to result in defective steel products, for example, upon restricted or throttled pouring of molten metal.

Also in this another embodiment of the molten metal discharging device, the stationary plate may be molded integrally with dense refractory material, or alternatively the stationary plate may comprise a gas supply member made of dense refractory material that constitutes at least a part of the circumferential wall of the passage bore and a main body of a stationary plate made of dense refractory material to which the gas supply member is fitted tightly, the gas supply holes being formed in the gas supply member. In the latter case, the gas introduction holes are, preferably, formed in the main body of the stationary plate and the chamber is defined by the gas supply member and the main body of the stationary plate.

In the molten metal discharging device according to this invention, each of the gas supply holes may have, in the lateral cross-section, an elongated shape or a circular shape or any other desired shapes.

In the case where the gas supply hole is of an elongated or slit-like or slot-like shape in the lateral cross-section thereof it is preferred that the slit or slot has a width or lateral size of between 0.1–0.5 mm and a length or longitudinal size of between 1–5 mm. If the cross-sectional size of the slit is less than 0.1 mm in the width or less than 1 mm in the length, the amount of gas supply may become insufficient to decrease the effect of preventing the clogging in the passage bore and, if it is larger than 0.5 mm in the width, molten metal may intrude into the slit, which may possibly lead to the clogging of the slit. If it is larger than 5 mm in length thereof, the stationary plate may not possibly be sufficient in strength.

In the case where the gas supply hole is of a circular shape in the lateral cross-section thereof, it is preferred that the hole has a diameter of between 0.1–1.0 mm and arranged at the center-to-center distance of the holes of 2–20 mm. If the gas supply hole is less than 0.1 mm in diameter, the bubble size will be too small to provide a sufficient effect for preventing clogging in the passage bore and, if it exceeds 1.0 mm in diameter, molten metal may intrude into the hole or slit, which may possibly lead to the clogging of the gas supply hole. Further, if the center-to-center distance of the gas supply holes exceeds 20 mm, the amount of supplied gas may become insufficient leading to the reduction in the effect of preventing cloggings in the passage bore and while, on the other hand, if it is less than 2 mm, the strength of the circumferential wall may be lowered and the corrosion-resistance thereof may also be lowered.

The molten metal discharging device according to this invention may comprise a 2-plate slide gate system or a 3-plate slide gate system.

BRIEF DESCRIPTION OF THE ACCOMPANYING DRAWINGS

This invention is to be described in more details referring to the accompanying drawings, by which the foregoing and other objects, as well as the features of this invention will be made clearer, and in which.

DESCRIPTION OF THE PREFERRED EMBODIMENTS

Explanation will now be made about a molten metal discharging device 16 as a first preferred embodiment according to this invention referring to FIG. 2.

Figure 2:
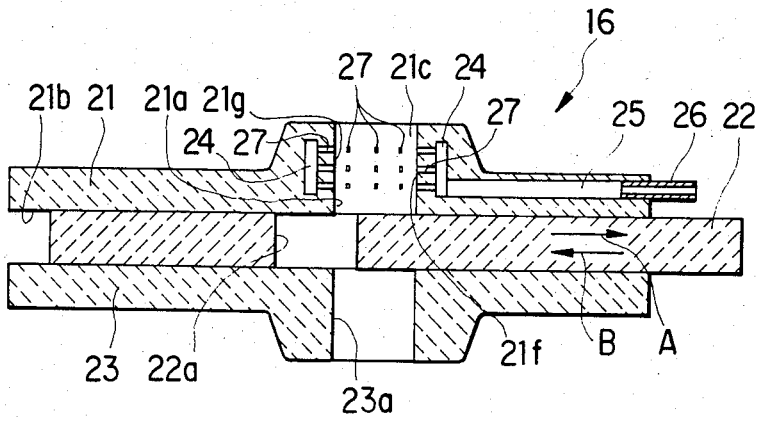
FIG. 2 is an explanatory cross-sectional view of a molten metal discharging device as a first preferred embodiment according to this invention.

In FIG. 2, the molten metal discharging device 16 comprises an upper stationary plate 21, a slide plate 22 and a lower stationary plate 23 respectively having molten metal passage bores or outlet apertures 21*a*, 22*a* and 23*a* each of 70 mm in diameter. These diameters may of course be different. The slide plate 22 is slidably displaced by means of a driving and displacing device such as a hydraulic cylinder or the like (not shown) in the direction A or B to open or close the passage bore 21*a*. The upper stationary plate 21 is made of dense refractory material and formed therein with a gas pressure-uniformalizing zone or uniform pressure zone 24 in the form of an annular space or chamber having a cross-section of 2 mm in width and 25 mm in height at a position spaced apart by 15 mm from the sliding face 21*b* relative to the slide plate 22. The upper stationary plate 21 is further formed with a gas introduction hole 25 in communication with the uniform pressure zone 24 and a gas introduction pipe 26 is connected to the gas introduction hole 25. Further, the upper stationary plate 21 is formed in its circumferential wall of the passage bore 21*a* with slit-like or slot-like holes 27 each of 0.2 mm in width and 5 mm in length by the number of thirty in total, that is, in three circumferential rows arranged vertically with the longitudinal direction of the slit or slot 27 being in parallel with the extending direction of the passage bore 21*a*, each row containing ten slits, as the gas supply holes for communicating the gas uniform pressure zone 24 with the passage bore 21*a*.

Figure 1:
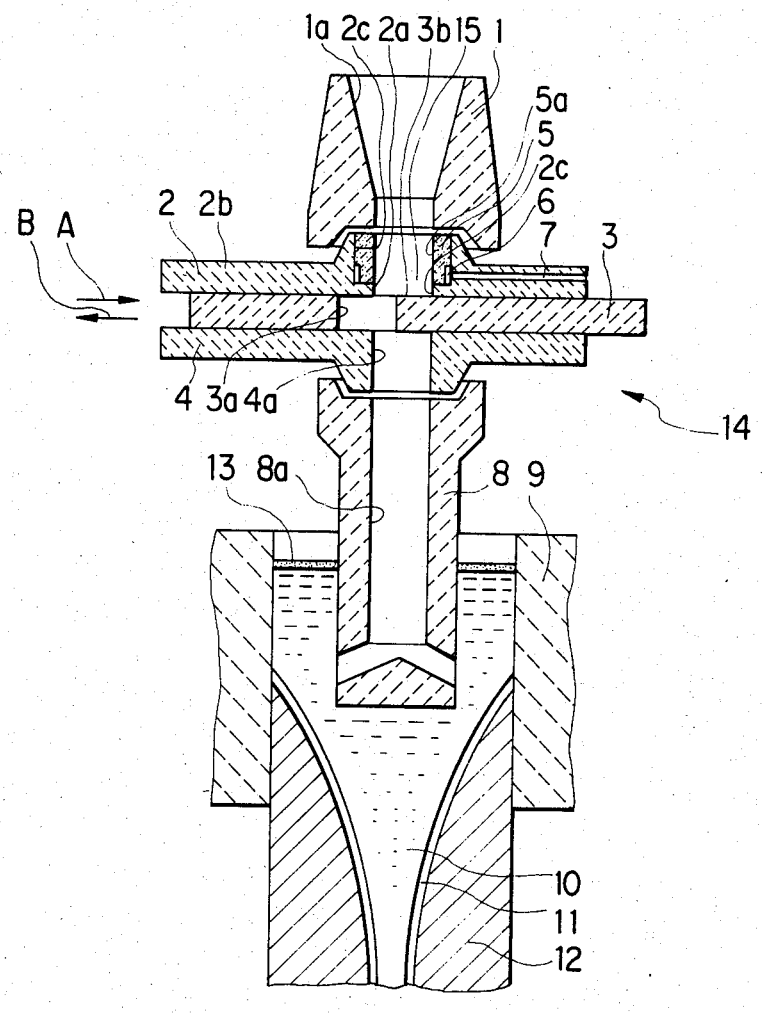
Fig. 1 PRIOR ART
FIG. 1 is an explanatory cross-sectional view showing an example of a conventional molten metal discharging device applied between a tundish and a mold of a continuous casting apparatus.

In the same manner as the conventional molten metal discharging device 14 illustrated in FIG. 1, the molten metal discharging device 16 according to this invention may be used, for instance, in a state in which the upper stationary plate 21 is mounted to the upper nozzle 1 at the bottom of the tundish and the lower stationary plate 23 is attached with a submerged nozzle therebelow.

For instance, the uniform pressure zone 24 and the slit-like holes 27, 27,—in the upper stationary plate 21 were produced by embedding hard papers corresponding in shape to the uniform pressure zone 24 and the slit-like holes 27 into the refractory-mixed body upon molding and then by burning them out during a sintering or burning process. The slit-like holes 27 may alternatively be formed after the sintering of the plate by means of ultrasonic or laser fabrication. The gas introduction hole 25 was formed by means of drilling work after the sintering.

In the molten metal discharging device 16 constituted as described above, since the inert gas of relatively large bubble size(s) can be supplied through the slit-like holes 27, 27,—while being controlled uniformly at any of the positions, fear of clogging in the passage bore 21*a* can be reduced. Further, since the inner surface 21*c* of the upper stationary plate 21 is made of dense refractory material, the inner surface 21*c* has a satisfactory corrosion-resistance against the molten metal. In addition, as the bubbles supplied in the passage bore 21*a* serve for removing non-metal impurities from the discharged molten metal, the purity of the molten metal transferred to the mold can be enhanced.

While each of the slits formed in the upper stationary plate 21 has a size of 0.2 mm in the width and 5 mm in the length in the molten metal discharging device 16 illustrated in FIG. 2, preferably, the size of the slit can optionally be selected within a range of between 0.1–0.5 mm in width and between 1–5 mm in length. Furthermore, the slit may be disposed with the longitudinal direction thereof being in parallel with the sliding face 21*b*.

Figure 3:
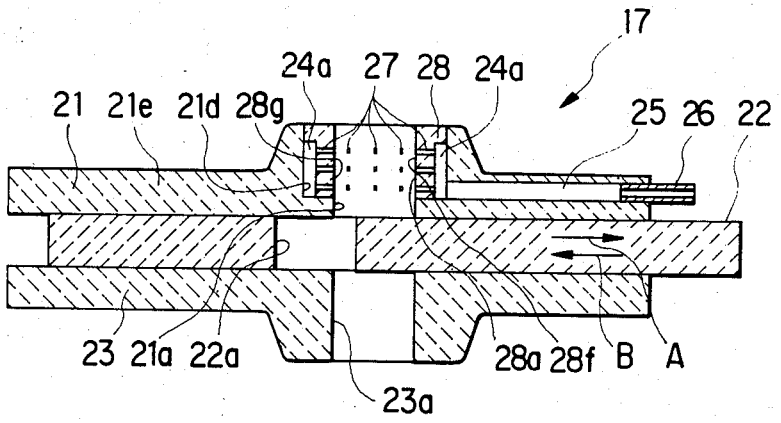
FIG. 3 is an explanatory cross-sectional view of a molten metal discharging device as a second preferred embodiment according to this invention.

Instead of disposing the slit-like holes 27, 27,—directly to the upper stationary plate 21 as illustrated in the molten metal discharging device 16, the upper stationary plate 21 may comprise an upper stationary plate main body 21*e* made of dense refractory material and having an annular recess 21*d* at the upper part of the passage bore 21*a* and an annular gas supply member 28 made of dense refractory material tightly fitted to the annular recess 21*d* of the main body 21*e*, thus to constitute a second preferred embodiment of a molten metal discharging device 17 according to this invention as shown in FIG. 3. In the molten metal discharging device 17, a uniform pressure zone 24*a* in the form of an annular space or chamber is defined between the main body 21*e* of the upper stationary plate and the annular gas supply member 28, and slit-like holes 27, 27,—are formed in the gas supply member 28 for communicating the uniform pressure zone 24*a* with the molten metal passage bore 28*a*, 21*a*. The molten metal discharging device 17 has the same advantageous effects as the device 16 and, in addition, it can be produced into a predetermined configuration with more ease than the device 16.

In the molten metal discharging device 16 or 17, each of the gas supply holes 27 formed in the upper stationary plate 21 made of dense refractory material for communicating the molten metal passage bore 21*a* or 28*a* with the uniform pressure zone 24 or 24*a* in the form of the annular chamber may be a hole having an other elongated shape in the cross-section thereof such as an ellipse or a hole having any other desired cross-sectional shape such as circle, square, polygon or parallelogram instead of the rectangular cross-sectional hole or slit-like hole 27 illustrated in the drawing. Further, different cross-sectional shapes of holes may be used together. In addition, the gas supply holes 27 in the circumferential wall of the passage bore 21*a* or 28*a* may either be distributed uniformly as shown in FIGS. 2 and 3 or distributed not-uniformly, for instance, such that they may be arranged at closer distances or pitches on one circumferential side 21*f* or 28*f* than on the other circumferential side 21*g* or 28*g* with respect to the sliding direction A or B of the slide plate 22. Further, as will be described later referring to FIGS. 4–6, the gas supply holes may not be formed on the side of the circumferential wall 21*g* or 28*g*. Furthermore, the gas supply holes may either be extended only in the radial direction within a horizontal plane, or inclined bent, for instance, relative to the vertical direction, in such a way that at least some of the gas supply holes may be obliquely extended upwardly or downwardly near the circumferential surface of the passage bore 21*a* or 28*a* and opened at their ends to the passage bore 21*a* or 28*a*.

The distribution pitch or density, the number, etc. as well as the size of the gas supply holes can be selected properly depending on the diameter of the bore 21*a* or 28*a*, the flow rate, kind and temperature of the molten metal passed through the bore 21*a* or 28*a* and the like, if desired.

The cross-sectional shape of the passage bore 21*a*, 28*a* and the uniform pressure zone 24, 24*a*, etc. may be of any desired shape such as an elliptic shape or the like, instead of the aforementioned circular shape.

In the case of disposing the gas supply holes bent or curved as described above, the uniform pressure zone 24 or 24*a* for making the pressure of the gas uniform may be saved, in which the gas supply holes 27, 27—may be connected, either independently from each other or collectively in several groups each having adequate number of holes, to the gas introduction hole 25.

Figure 4:
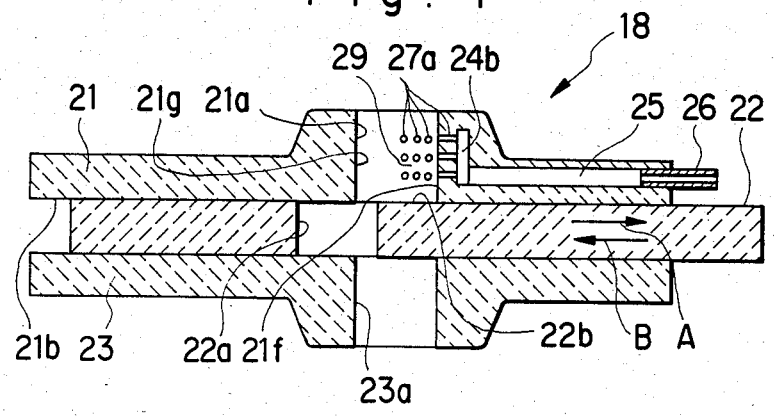
FIG. 4 is an explanatory cross-sectional view of a molten metal discharging device as a third preferred embodiment according to this invention.
Figure 5:
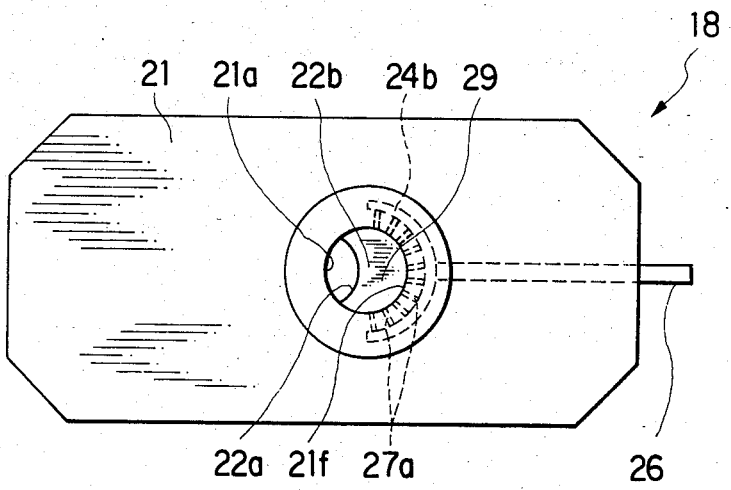
FIG. 5 is an explanatory plan view of the device shown in FIG. 4.

Description will next be made to an embodiment in which the gas supply holes are disposed in the upper stationary plate only on the side 21*f* or 28*f* of the circumferential wall of the passage bore 21*a* or 28*a*. The side 21*f* or 28*f* is a side from which the bore 21*a* or 28*a* is started to be closed by the slide plate 22 when the slide plate 22 is moved to close the passage bore 21*a* or 28*a* in the direction B. In FIGS. 4 and 5, the same elements as those in the devices 16, 17 in FIGS. 2, 3 carry the same reference numerals.

FIG. 4, illustrates a molten metal discharging device 18 of the third embodiment according to this invention comprising an upper stationary plate 21, a slide plate 22 and a lower plate 23 respectively having passage bores 21*a*, 22*a* and 23*a* each of 60 mm in diameter. In the molten metal discharging device 18, a gas pressure-uniformalizing zone or uniform pressure zone 24*b* in the form of a semi-circular space or chamber having a cross-section of 2 mm in width and 25 mm in height is formed to in the upper stationary plate 21 made of dense refractory material at a position spaced apart by 15 mm from the sliding face 21*b* relative to the slide plate 22. Further, as shown in FIGS. 4 and 5, small holes 27*a*, 27*a*,—, each having circular cross-section and being 0.2 mm in diameter, are formed on the side 21*f* of the circumferential wall by the number of thirty in total, that is, in three semi-circumferential rows arranged with 10 mm of vertical distance to each other, each row containing ten holes, as the gas supply holes for communicating the uniform pressure zone 24*b* with the passage bore 21*a*.

In the same manner as the conventional molten metal discharging device 14 illustrated in FIG. 1, the molten metal discharging device 18 may also be used, for instance, in a state in which the upper stationary plate 21 is mounted to the upper nozzle 1 of the tundish (not shown) and the lower stationary plate 23 is attached with the submerged nozzle 8 therebelow.

The gas introduction hole 25, the uniform pressure zone 24*b* and the small holes 27*a* of the device 18 can be produced or prepared in the same manner as the gas introduction hole 25, uniform pressure zone 24 and the slits 27 in the device 16.

For instance, the chamber 24*b* and the small holes 27*a*, 27*a*,—in the upper stationary plate 21 were produced by embedding hard papers having a shape corresponding to the uniform pressure zone 24*b* and vinyl chloride wires having shapes corresponding to the small holes 27*a*, 27*a*,—in a refractory-mixed body upon molding and then by burning out them during the sintering or burning process.

In the molten metal discharging device 18 thus constituted, since the inert gas of relatively large bubble size(s) is supplied through the small holes 27*a*, 27*a*,—to the inside of the passage bore 21*a*, fear of clogging in the passage bore 21*a* can surely be reduced. Further, since the circumferential wall of the passage bore 21*a* of the upper stationary plate 21 is made of dense refractory material, it has a satisfactory corrosion-resistance against the molten metal.

In the molten metal discharging device 18, the uniform pressure zone 24*b* is provided in a semi-circular shape within the upper stationary plate 21 on the side 21*f* from which the bore 21*a* is to be closed by the slide plate 22 when the slide plate 22 is moved to close the passage bore 21*a* and the small holes 27*a*, 27*a*,—for communicating the uniform pressure zone 24*b* with the passage bore 21*a* are disposed on the side 21*f* of the circumferential wall of the passage bore 21*a*. Such small holes 27*a*, 27*a*,—are desirably disposed within a range between $\frac{1}{3}$–$\frac{2}{3}$ of the entire circumference on the side 21*f* of the circumferential wall of the passage bore 21*a* in the upper stationary plate 21 because of the reason as described below.

The molten metal discharging device, for instance, the conventional device 14 has to withstand the conditions during casting for a long time (e.g., 5–10 hours) in the continuous casting process. Accordingly, the cross-sectional area for the passage bore 2*a*, etc. of the device 14 has been designed 3.5–4.5 times as large as the cross-sectional area capable of pouring a required flow rate of molten steel in order to maintain such a flow rate even when various oxides should be deposited on the circumferential wall surface of the passage bores 2*a* etc. and the degree of opening of the passage bore 2*a* has been set or throttled to 35–45% of the entire area at the initial stage of the casting for conducting the so-called restricted or throttled pouring by positioning the slide plate 3 to a position as illustrated in FIG. 1 for example. In this case, since there is little flow of the molten steel passing through the corner region 15 defined by the upper face 3*b* of the slide plate 3 (closing portion) and by the inner wall faces 2*c*, 5*a* of the upper stationary plate body 2*b* and the gas supply member 5, heat of the molten steel at the corner region 15 may be removed by the surrounding refractory material around the region 15 and the steel may be cooled to a partially-molten state at the region 15. In addition, the metal oxides are likely to be deposited on the refractories defining the region 15, which may possibly lead to clogging in the passage bore 2*a*. Consequently, it is necessary to agitate the molten steel by the supply of the inert gas. However, if a large amount of gas is supplied from the entire circumference of the passage bore 5*a* as shown in the discharging device 14 of FIG. 1, there is fear that an excess amount of gas may be incorporated into the molten steel and carried into the mold 9, which may possibly lead to the inclusion of the mold powder 13 in the molten steel or generation of pin-holes in the solidified layer 12 in the mold 9 due to the presence of the gas to result in defective steel products. On the contrary, if the amount of supplied gas is insufficient in the device 14, clogging in the passage bore 2*a* can be hardly avoided. While on the other hand, in the molten metal discharging device 18 shown in FIGS. 4 and 5, since the small holes 27*a* as the gas supply holes are disposed on the side 21*f* of the circumferential wall of the bore 21*a* of the upper stationary plate 21 and no or few such holes 27*a* are disposed on the opposite side 21*f* of the circumferential wall where the passage bore 21*a* is opened upon restricted or throttled pouring, stagnation of the molten steels at a corner region 29 defined by the wall portion 21*f* and the upper face 22*b* of the slide plate 22 can be substantially avoided by the gas supplied from the holes 27*a* to prevent the clogging in the passage bore 21*a* and fear of substantial introduction of gas into the mold 9 can also be avoided.

Therefore, the molten metal discharging device 18 can be stably operated for a longer time even upon restricted or throttled pouring under a reduced degree of opening of the passage bore 21*a* and, thus, the device is particularly useful for carrying out the continuous casting process.

If the range in which the small holes 27*a* are disposed on the side 21*f* of the circumferential wall is narrower than $\frac{1}{3}$ of the entire circumference, the amount of the gas may become insufficient to reduce the effect of preventing the clogging in the passage bore 21*a* and, while on the other hand, if it is larger than $\frac{2}{3}$, an excess amount of the gas will tend to be introduced into the mold 9 to result in defective steel products.

Although the small holes of 0.2 mm diameter are formed in the upper stationary plate 21 as the gas supply holes in this device 18 the diameter of the hole may be changed. However, it is preferred to select the diameter of each small hole within a range of between 0.1–1.0 mm.

Figure 6:
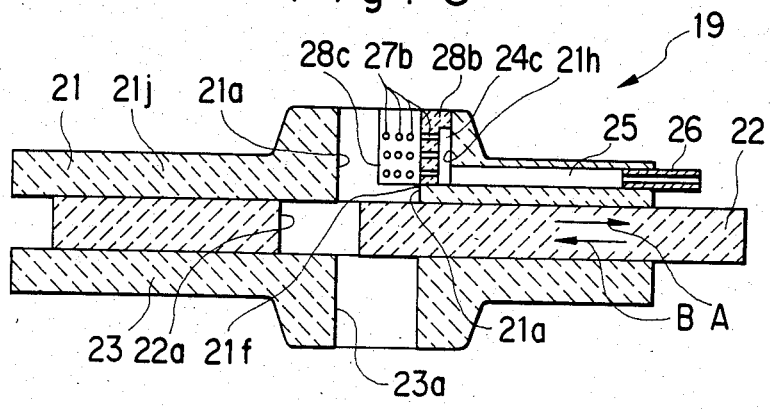
FIG. 6 is an explanatory cross-sectional view of a molten metal discharging device as a fourth preferred embodiment according to this invention.

Further, although the small holes 27*a*, 27*a*,—are formed in the upper stationary plate 21 itself in the molten metal discharging device 18 shown in FIGS. 4, 5, the upper stationary plate 21 may comprise a main body 21*j* made of dense refractory material having a semi-circular recess 21*h* at an upper part of one side of the circumference of the passage bore 21*a*, and a semi-circular gas supply member 28*b* made of dense refractory material tightly fitted to the semi-circular recess 21*h* by means of cement mortar, to constitute a molten metal discharging device 19 of fourth embodiment according to this invention as shown in FIG. 6.

In the molten metal discharging device 19, the gas supply member 28*b* defines a uniform pressure zone 24*c* in the form of a semi-circular space in cooperation with the main body 21*j* of the upper stationary plate and has small holes 27*b*, 27*b*,—therein for communicating the chamber 24*c* with the molten metal passage bore 21*a*.

The concave surface 28*c* of the gas supply member 28*b* is continuously connected with the circumferential face of the bore 21*a* in the main body 21*j* and both of the surface 28*c* and the circumferential face of the bore 21*a* in the body 21*j* cooperatively constitute a cylindrical molten metal passage bore 21*a*.

The molten metal discharging device 19 has the same advantageous effects as the device 18 and, further, it can be produced into a predetermined configuration with more ease than the device 18.

Figure 7:
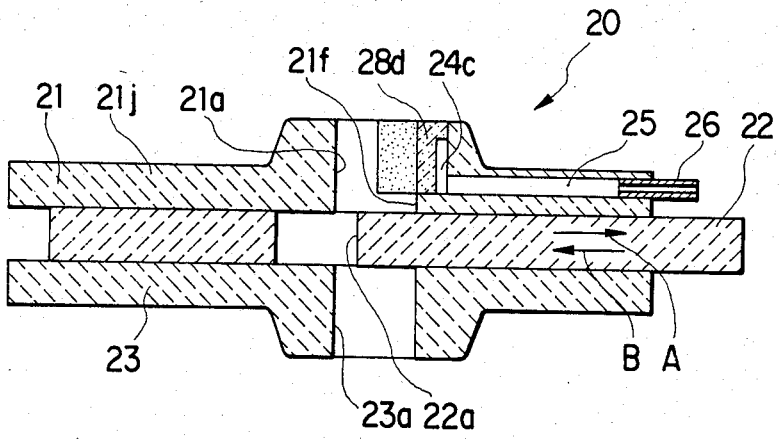
FIG. 7 is an explanatory cross-sectional view of a molten metal discharging device as a fifth preferred embodiment according to this invention.
Figure 8:
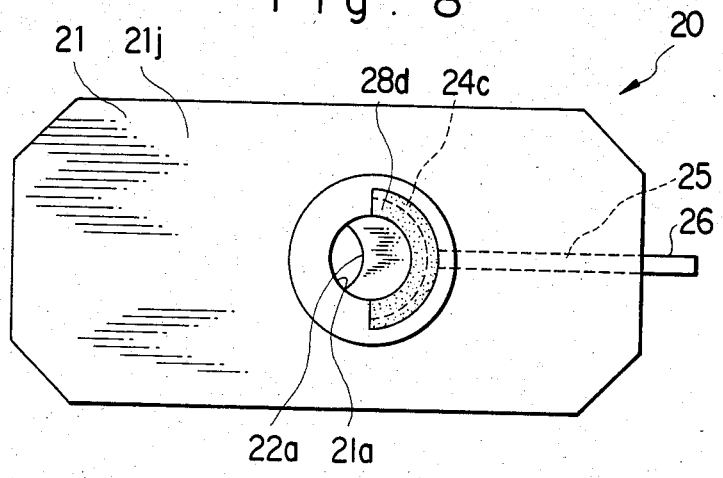
FIG. 8 is an explanatory plan view of the device shown in FIG. 7.

In the case of disposing the gas supply member on one side 21*f* of the circumferential wall for the bore 21*a*, the molten metal discharging device may also be constituted in the form of a device 20 as shown in FIGS. 7, 8 by using a gas supply member 28*d* made of porous refractory material instead of the gas supply member 28*b* made of dense refractory material in the device 19 of FIG. 6.

Specifically, in the molten metal discharging device illustrated in FIGS. 7, 8, the semi-circular gas supply member 28*d* made of porous refractory material is tightly fitted by means of cement mortar to the upper central recess of the main body 21*j* of the upper stationary plate 21 to define a semi-circular uniform pressure zone 24*c* between them. Further, the main body 21*j* of the upper stationary plate is formed with a gas introduction hole 25 in communication with the uniform pressure chamber 24*c* and a gas introduction pipe 26 is connected to the gas introduction hole 25. In the device illustrated in FIGS. 7, 8, the same or similar elements to those in FIGS. 2 to 6 have the same reference numerals.

In the same manner as the molten metal discharging device 14 shown in FIG. 1, the molten metal discharging device 20 may be used, for instance, in such a state where the upper stationary plate 21 is mounted to the upper nozzle 1 of the tundish (not shown) and the lower stationary plate 23 is attached with the submerged nozzle 8 therebelow.

In this case, the gas supply hole means comprises pores in the porous refractory member 28*d* but, alternatively or additionally, those apertures or holes such as of a slit-like or circular cross-section similar to holes 27*b* may further be formed in the porous refractory member 28*d*.

In the case of using the porous gas supply member, it is preferred to use highly corrosion-resistant material such as high alumina refractories, magnesia refractories, zircon refractories, zirconia refractories or the like.

The molten metal discharging device 20 is suitable for use in the continuous casting process as the molten metal discharging devices 18, 19 shown in FIGS. 4 to 6 because it is suitable for the restricted or throttled pouring.

Although the foregoing descriptions have been made to the molten metal discharging devices of a so-called 3-plate slide gate system, comprising an upper stationary plate, a slide plate and a lower stationary plate, it is apparent that the molten metal discharging device according to this invention can also be constituted in the form of a so-called 2-plate slide gate system comprising a single stationary plate to be mounted for example to the upper nozzle of a tundish and a slide plate slidable relative to the single stationary plate, in which the slide plate is displaced integrally with a submerged nozzle or the like to be attached to the bottom thereof, by forming its single stationary plate in the same structure as that of any one of the upper stationary plates in the foregoing embodiments.

Furthermore, it is also apparent that the molten metal discharging device according to this invention can, of course, be mounted not only to the bottom of the tundish but also to the bottom of the ladle or the like.

EXAMPLE 1

Continuous casting was carried out by connecting two conventional molten metal discharging devices 14 and two molten metal discharging devices 16 as the first embodiment according to this invention to four strands of a tundish having a capacity of 30 ton, into which aluminum-killed steel of 0.035% aluminium sol. were continuously poured from a ladle having a capacity of 160 ton. More specifically, two conventional devices 14 were connected to two strands of upper nozzles at the bottom of the tundish and two devices 16 were connected to the remaining two strands of upper nozzles at the bottom of the tundish respectively. The following results were obtained.

At first, molten steel was poured from the ladle into the tundish while keeping the passage bores 2a, 21a of the molten metal discharging devices 14, 16 closed by the slide plates 3, 22 and blowing argon gas at a flow rate of 150 liter/min. into the passage bores 2a, 21a respectively. When the level of the molten steels in the tundish reached about 60 cm in height, the slide plates 3, 22 were displaced in the direction A to open the passage bores 2a, 21a of the molten metal discharging devices 14, 16. In this case, one of the conventional molten metal discharging devices 14 failed to flow out the molten steels and it was required to open the passage bore by means of oxygen. Then, the molten steel was continuously cast by the volume corresponding to the contents in seven ladles while adjusting the argon gas flow rate to the passage bores 20, 21a to 10 liter/min. respectively. Since the flow rate of the molten steels to the mold 9 became insufficient for a predetermined casting rate at the latter-half stage of pouring from the sixth ladle in each of the molten metal discharging devices 14, 16, the flow rate of the argon gas to each of the passage bores 2a, 21a was temporarily increased to 50 liter/min. in order to remove the clogging matters in the passage bores 20, 21a and, thereafter, the flow rate was reduced again to 10 liter/min. In this case, the flow rate of the molten steel returned to the normal level in each of the strands combined with the molten metal discharging devices 16 of the first embodiment according to this invention, but the flow rate of the molten steel was gradually decreased leading to the state incapable of casting in each of the strands combined with the conventional molten metal discharging devices 14. The differences are considered to have been obtained by the differences in the effects that the clogging in the passage bore 2a could not effectively be prevented by the supply of the gas in the conventional molten metal discharging devices 14 because of the insufficient agitation of the molten steel by the small bubbles of the gas, and that, the clogging in the passage bore 21a could be effectively prevented in the molten metal discharging devices 16 as the first embodiment according to this invention because of the large agitation of the molten steel by relatively large bubbles of the gas.

EXAMPLE 2

The casting test was carried out on two molten metal discharging devices 18 as the third embodiment according to this invention and two conventional molten metal discharging devices 14 in the same manner as in Example 1 excepting that the flow rate of the argon gas at the initial and the subsequent casting stages was adjusted at 7 liter/min. instead of 10 liter/min. Then, quite the same effects as described in Example 1 were obtained that the devices 18 can be operated better than the devices 14.

It may be considered from the results of Example 2 that while no effective prevention can be attained against the clogging in the passage bore 2a in the conventional molten metal discharging device 14 because of the insufficient agitation force of the gas to the molten steel, the clogging in the passage bore 21a could be effectively prevented in the molten metal discharging device 18 as the third embodiment according to this invention because of the large agitation force of the gas to the molten steel.

EXAMPLE 3

Continuous casting was carried out by connecting two conventional molten metal discharging devices 14 and two molten metal discharging devices 20 as the fifth embodiment according to this invention to four strands of a tundish having a capacity of 30 ton, into which alminium-killed steels of 0.035% aluminium sol., were continuously poured from a ladle having a capacity of 160 ton. More specifically, two conventional devices were connected to two strands of upper nozzles at the bottom of the tundish and two devices 20 were connected to the remaining two strands of upper nozzles at the bottom of the tundish respectively. The following results were obtained.

At first, molten steels were poured from the ladle to the tundish while keeping the passage bores 2a, 21a of the molten metal discharging devices 14, 20 closed by the slide plates 3, 22 and blowing argon gas at a flow rate of 150 liter/min. into the passage bores 2a, 21a respectively. When the level of the molten steel in the tundish reached about 60 cm in height, the slide plates 3, 22 were displaced in the direction A so as to partially open the passage bores 2a, 21a of the molten metal discharging devices 14, 20 to the opening degree of about 35% as shown in FIGS. 1, 7 for carrying out the restricted or throttled pouring and molten steel corresponding in volume to the contents in seven ladles were continuously cast while controlling the flow rate of the argon gas to 30 liter/min. In this case, although defective steel products were produced in the conventional molten metal discharging devices 14 due to the inclusion of the mold powder 13 into the molten steel, no such defective steel products were produced in the molten metal discharging device 20 as the fifth embodiment according to this invention.

What is claimed is:

1. A molten metal discharging device comprising:

a stationary plate adapted to be mounted at a bottom portion of a container for accommodating molten metal, the stationary plate having a molten metal passage bore for permitting the molten metal from the container to be discharged therethrough; and a slide plate slidable along a lower face of the stationary plate and adapted to open or close the passage bore by being slidably displaced relative to the stationary plate wherein a circumferential wall of the passage bore in the stationary plate is made of dense refractory material and said circumferential wall further comprises means formed in said circumferential wall for permitting a gas to be supplied into the passage bore and for preventing soldification of the molten metal in the passage bore by the gas supplied thereinto and wherein said means formed in said circumferential wall further comprises a plurality of gas supply holes wherein the gas supply holes are formed to a greater extent on a side of the circumferential wall from which the bore is started to be closed by the slide plate, when the slide plate is moved to close the passage bore, so as to prevent clogging on a partially closed side and to avoid excessive communication of gas into a stream of molten metal passing through said passage bore.

2. The device according to claim 1, in which the stationary plate has a gas introduction hole communicated with the plurality of gas supply holes so as to supply the gas from an outside source to the plurality of gas supply holes.

3. The device according to claim 2, in which the stationary plate has a chamber therein for communicating the gas introduction hole with the plurality of gas supply holes, and the chamber is adapted such that the gas may be supplied from each of the plurality of gas supply holes substantially at a same level of pressure into the passage bore.

4. The device according to claim 1, in which the gas supply holes are formed only on said one side of the circumferential wall and within a predetermined range with respect to the circumferential direction of the passage bore.

5. The device according to claim 1, in which each of the gas supply holes has an elongated configuration in a lateral cross section thereof.

6. The device according to claim 5, in which each of the gas supply holes has a slit-like configuration in the lateral cross section.

7. The device according to claim 6, in which the slit is 0.1–0.5 mm in width and 1–5 mm in length.

8. The device according to claim 7, in which said device is for use in molten steel.

9. The device according to claim 8, in which said device comprises a 2-plate slide gate system.

10. The device according to claim 8, in which said device comprises a 3-plate slide gate system.

11. The device according to claim 1, in which each of the gas supply holes has a circular configuration in a lateral cross section thereof.

12. The device according to claim 11, in which the circle is 0.1–1.0 mm in diameter.

13. The device according to claim 12, in which the center-to-center distance of the gas supply holes is between 2–20 mm.

14. The device according to claim 13, in which said device is for use in molten steel.

15. The device according to claim 14, in which said device comprises a 2-plate slide gate system.

16. The device according to claim 14, in which said device comprises a 3-plate slide gate system.

17. A molten metal discharging device, comprising:

a stationary plate adapted to be mounted at a bottom portion of a container for accommodating molten metal, the stationary plate having the molten metal passage bore for permitting the molten metal from the container to be discharged therethrough; and a slide plate slidable along a lower face of the stationary plate and adapted to open or close the passage bore by being slidably displaced relative to the stationary plate wherein a circumferential wall of the passage bore in the stationary plate is made of dense refractory material and said circumferential wall further comprises means formed in said circumferential wall for permitting a gas to be supplied into the passage bore and for preventing solidification of the molten metal in the passage bore by the gas supplied thereinto and wherein said means formed in said circumferential wall further comprises a plurality of gas supply holes;

the stationary plate having a gas introduction hole communicated with said plurality of gas supply holes so as to supply the gas from an outside source to said plurality of gas supply holes and wherein the stationary plate has a chamber formed therein for communicating the gas introduction hole with the plurality of gas supply holes, the chamber being adapted such that the gas may be supplied from each of the plurality of gas supply holes substantially at a same level of pressure into the passage bore, said gas supply holes being formed to a greater extent on a side of the circumferential wall from which the bore is started to be closed by the slide plate when the slide plate is moved to close the passage bore so as to prevent clogging on a partially closed side and to avoid excessive communication of gas into a stream of molten metal through said passage bore, wherein the gas supply holes are formed only on said one side of said circumferential wall and within a predetermined range with respect to the circumferential direction of the passage bore wherein the predetermined range where the gas supply holes are formed is between $\frac{1}{3}$–$\frac{2}{3}$ of an entire circumference of said passage bore.

18. The device according to claim 17, in which the stationary plate is integrally molded from dense refractory material.

19. The device according to claim 17, in which the stationary plate comprises a gas supply member made of dense refractory material constituting at least a part of the circumferential wall of the passage bore and a main body of the stationary plate made of dense refractory material to which the gas supply member is tightly fitted, and the gas supply holes are formed in the gas supply member made of dense refractory material.

20. The device according to claim 19, in which the gas introduction hole is formed in the main body of the slide plate and the chamber is defined by the gas supply member and the main body of the stationary plate.

21. A molten metal discharging device comprising:

a stationary plate adapted to be mounted at a bottom portion of a container accomodating molten metal, the stationary plate having a molten metal passage bore for permitting the molten metal from the container to be discharged therethrough, and a slide plate slidable along a lower face of the stationary plate and adapted to open or close the passage bore by being slidably displaced relative to that stationary plate, in which the stationary plate comprises a gas supply member made of refractory material and constituting a part of a circumferential wall of the passage bore, the gas supply member being disposed only on one side of the circumferential wall in the sliding direction of the slide plate over a predetermined range in a circumferential direction of the passage bore, and a main body of the stationary plate made of dense refractory material to which said gas supply member is tightly fitted, the gas supply member has a plurality of gas supply hole means for permitting the supply of the gas into said passage bore, and the stationary plate has a chamber communicated with the plurality of gas supply hole means so as to supply the gas to the plurality of gas supply hole means substantially at a same level of pressure and a gas introduction hole for introducing the gas from an outside into the chamber.

22. The device according to claim 2, in which said one side is a side of the circumferential wall of the passage bore from which the bore is started to be closed by the slide plate when the slide plate is moved to close the passage bore.

23. The device according to claim 22, in which the predetermined range where the gas supply hole means are formed is between a range $\frac{1}{3}$–$\frac{2}{3}$ of an entire circumference of the passage bore.

24. The device according to claim 23, in which the gas supply member is made of dense refractory material, and the gas supply hole means comprises a plurality of holes formed in the gas supply member made of dense refractory material.

25. The device according to claim 23, in which the gas supply member is made of porous refractory material and the gas supply hole means comprises pores present in the gas supply member of porous refractory material.

26. A molten metal discharging device comprising:

a stationary plate adapted to be mounted at a bottom portion of a container for accommodating molten metal, the stationary plate having a molten metal passage bore for permitting the molten metal from the container to be discharged therethrough; and a slide plate slidable along a lower face of the stationary plate and adapted to open or close the passage bore by being slidably displaced relative to the stationary plate wherein a circumferential wall of the passage bore in the stationary plate is made of dense refractory material and said circumferential wall further comprises means formed in said circumferential wall for permitting a gas to be supplied into the passage bore and for preventing solidification of the molten metal in the passage bore by the gas supplied thereinto wherein said means formed in said circumferential wall consists of a plurality of gas supply holes formed in a range between $\frac{1}{3}$–$\frac{2}{3}$ of an entire circumference of said circumferential wall.

27. A molten metal discharging device comprising:

a stationary plate adapted to be mounted at a bottom portion of a container for accommodation molten metal, the stationary plate having a molten metal passage bore for permitting the molten metal from the container to be discharged therethrough; and a slide plate slidable along a lower face of the stationary plate and adapted to open or close the passage bore by being slidably displaced relative to the stationary plate wherein a circumferential wall of the passage bore in the stationary plate is made of dense refractory material and said circumferential wall further comprises means formed in said circumferential wall for permitting a gas to be supplied into the passage bore and for preventing solidification of the molten metal in the passage bore by the gas supplied thereinto and wherein said means formed in said circumferential wall further comprises a plurality of gas supply holes;

the stationary plate having a gas introduction hole communicated with said plurality of gas supply holes so as to supply the gas from an outside source to said plurality of gas supply holes and wherein the stationary plate has a chamber formed therein for communicating the gas introduction hole with the plurality of gas supply holes, the chamber being adapted such that the gas may be supplied from each of the plurality of gas supply holes substantially at a same level of pressure into the passage bore, said gas supply holes being formed to a greater extent on a side of the circumferential wall from which the bore is started to be closed by the slide plate when the slide plate is moved to close the passage bore, so as to prevent clogging on a partially closed side and to avoid excessive communication of gas into a stream of molten metal through said passage bore, wherein the gas supply holes are formed only on said one side of said circumferential wall and within a predetermined range with respect to the circumferential direction of the passage bore.

* * * * *